United States Patent [19]

Iwata

[11] Patent Number: 4,462,219

[45] Date of Patent: Jul. 31, 1984

[54] REFRIGERATION SYSTEM

[75] Inventor: Takayuki Iwata, Fujinomiya, Japan

[73] Assignee: Tokyo Shibaura Denki Kabushiki Kaisha, Kawasaki, Japan

[21] Appl. No.: 376,499

[22] Filed: May 10, 1982

[30] Foreign Application Priority Data

May 13, 1981 [JP] Japan ..... 56-68996[U]

[51] Int. Cl.[3] ..... F25B 41/04; F25B 41/06

[52] U.S. Cl. ..... 62/196.1; 62/DIG. 17

[58] Field of Search ..... 62/DIG. 17, 197, 198, 62/196 R

[56] References Cited

U.S. PATENT DOCUMENTS

| | | | |
|---|---|---|---|
| 2,258,458 | 10/1941 | Lange | 62/197 X |
| 2,936,595 | 5/1960 | Dillman et al. | 62/197 |
| 3,014,352 | 12/1961 | Leimbach | 62/197 |
| 3,243,970 | 4/1966 | Lippincott | 62/197 |
| 4,238,932 | 12/1980 | Schrader | 62/197 |

*Primary Examiner*—William E. Tapolcai

*Attorney, Agent, or Firm*—Cushman, Darby & Cushman

[57] ABSTRACT

A refrigeration system comprises a main circuit including a compressor, a condenser, a main capillary tube, and an evaporator whereby a coolant is circulated through the main circuit to effect a refrigerating cycle, a bypass circuit including an auxiliary capillary tube the inlet side of which is connected to the high pressure side of the compressor, and an electromagnetic valve the inlet side of which is connected to the outlet side of the auxiliary capillary tube and the outlet side of which is connected to the low pressure side of the compressor, a circuit breaker switch acting to disconnect the main circuit when the pressure of the coolant reaches a first preset pressure, and a bypass switch acting to open the electromagnetic valve to cause part of the coolant from the outlet side of the condenser to flow through the auxiliary capillary tube and electromagnetic valve to the low pressure side of the compressor when the pressure of the coolant reaches a second preset pressure lower than the first preset pressure.

5 Claims, 4 Drawing Figures

REFRIGERATION SYSTEM

BACKGROUND OF THE INVENTION

This invention relates to refrigeration systems used for air conditioners or the like.

The refrigeration system of this kind usually has a main circuit 5 as shown in FIG. 1, including a compressor 1, a condenser 2, a capillary tube 3 and an evaporator 4, these parts being connected in the order mentioned. In this main circuit 5, a high temperature, high pressure coolant gas, having been compressed in the compressor 1, is fed into the condenser 2, and the liquid coolant liquefied in the condenser 2 is fed, after being expanded by pressure reduction in the capillary tube 3, to the evaporator 4. As the liquid coolant is evaporated in the evaporator 4, the ambient air is cooled. In order to bypass part of the coolant fed out from the condenser 2 in the main circuit 5 to the low pressure side of the compressor, a bypass circuit 8 including an electromagnetic valve 6 and an auxiliary capillary tube 7 is connected between the low pressure side of the compressor 1 and the high pressure side thereof. Further, between the condenser 2 and capillary tube 3 of the main circuit 5 there are provided a circuit breaker switch 9 and a bypass switch 10, these switches being sensitive for their operation to the pressure of the coolant. The circuit breaker switch 9 functions to disconnect the main circuit 5 to stop an air conditioner or the like when a first preset pressure P1 (for example, 26 kg/cm$^2$) is reached by the pressure of the coolant. The bypass switch 10 acts to open the electromagnetic valve 6 when a second preset pressure P2 (for example, 22 kg/cm$^2$) lower than the aforementioned first preset pressure P1 is reached by the pressure of the coolant. Thus, when the pressure of the coolant gas being compressed by the compressor 1 is increased, the electromagnetic valve 6 is opened to let part of the liquid coolant having been fed out from the condenser 2 to be bypassed through the bypass circuit 8 so as to prevent overcooling by the evaporator 4.

With the prior art refrigeration system as described above, when the electromagnetic valve 6 is opened with the bypass switch 10 turned on in response to the reaching of the second preset pressure P2 by the pressure of the coolant passing through the main circuit 5, part of the liquid coolant fed out from the condenser 2 is caused to rush into the bypass circuit 8. Consequently, immediately after the instant T of opening of the electromagnetic valve 6 the pressure of the coolant is temporarily reduced as shown in FIG. 2. However, since the rate of flow of the coolant into the bypass circuit 8 is limited, the coolant which is not admitted into the bypass circuit 8 is temporarily retained in the neighborhood of the inlet of the bypass circuit 8, thus resulting in a sharp increase of the pressure of the coolant. After the lapse of about 0.5 second from the opening of the electromagnetic valve 6, the pressure of the coolant exceeds the first preset pressure P1. Therefore, the circuit breaker switch 9 is turned on so that the air conditioner is unnecessarily stopped. To preclude such deficiency, it is necessary to set the pressure difference between the first and second preset pressures to a comparatively large value for preventing the air conditioner from being stopped due to a transient pressure increase as mentioned above.

SUMMARY OF THE INVENTION

An object of the present invention is to provide a refrigeration system, with which the pressure difference between the first and second preset pressures can be set to a comparatively small value without the possibility for the main circuit to be disconnected due to a sudden increase of the pressure of the coolant immediately after the coolant is partly admitted into the bypass circuit.

In an aspect of the present invention, there is provided a refrigeration system comprising a main circuit including a compressor, a condenser connected to the high pressure side of the condenser, a main expansion mechanism connected to the outlet side of the condenser and an evaporator connected to the outlet side of the main expansion mechanism, the outlet side of the evaporator being connected to the low pressure side of the compressor, a coolant being circulated through the main circuit to effect a refrigeration cycle, a bypass circuit including an auxiliary expansion mechanism having the inlet side connected to the high pressure side of the compressor and an on-off valve having the inlet side connected to the outlet side of the auxiliary expansion mechanism and the outlet side connected to the low pressure side of the compressor, a circuit breaker switch operative in accordance with the pressure of the coolant flowing through the main circuit and acting to disconnect the main circuit when the pressure of the coolant reaches a first preset pressure, and a bypass switch operative in accordance with the pressure of the coolant and acting to open the on-off valve so as to cause part of the coolant from the outlet side of the condenser to flow through the auxiliary expansion mechanism and on-off valve to low pressure side of the compressor when the pressure of the coolant reaches a second preset pressure lower than the first preset pressure.

BRIEF DESCRPITION OF THE DRAWINGS

DETAILED DESCRIPTION OF THE PREFERRED EMBODIMENT

Now, an embodiment of the refrigeration system according to the present invention will be described with reference to the accompanying drawings.

Figure 1:
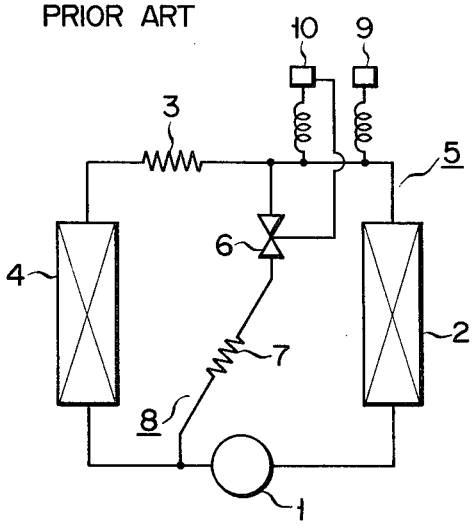
FIG. 1 PRIOR ART
FIG. 1 is a view showing a prior art refrigeration system.
Figure 2:
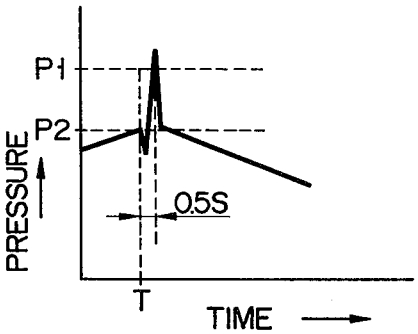
FIG. 2 PRIOR ART
FIG. 2 is a graph showing the operational characteristic of the prior art refrigeration system.
Figure 3:
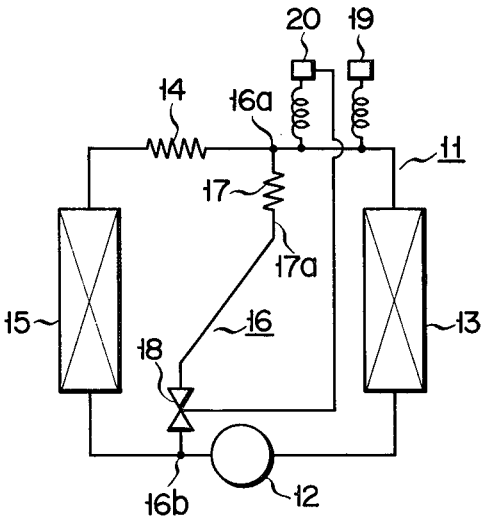
FIG. 3 is a view showing one embodiment of the refrigeration system according to the invention.

Referring to FIG. 3, reference numeral 12 designates a compressor. The high pressure side or outlet side of the compressor is connected to the inlet side of a condenser 13 through a duct with an outer diameter of 15.88 mm. The outlet side of the condenser 13 is connected through a main capillary tube (or expansion mechanism) 14 with an outer diameter of 1.7 mm and a length of 2,300 mm to the inlet side of an evaporator 15 by a duct with an outer diameter of 6 mm. The outlet side of the evaporator 15 is connected to the low pressure side or inlet side of the compressor 12 by a duct with an outer diameter of 28.58 mm. The component parts mentioned above constitute a main circuit 11 which effects a well-known refrigeration cycle.

Reference numeral 16 designates a bypass circuit constructed by a duct with an outer diameter of 6 mm and a length of 3,900 mm, which has one end 16*a* connected to the path between the outlet side of the condenser 13 and the inlet side of the main capillary tube 14 and the other end 16*b* connected to the path between the low pressure side of the compressor 12 and the outlet side of the evaporator 15.

The bypass circuit 16 is constituted by a series circuit including an auxiliary capillary tube 17 with an outer diameter of 1.7 mm and a length of 2,300 mm and an electromagnetic valve (on-off valve) 18. The inlet side of the auxiliary capillary tube 17 is connected to the aforementioned one end 16*a* of the bypass circuit 17, that is the high pressure side of the condenser, while the outlet side of the tube 17 is connected to the inlet side of the electromagnetic valve 18, the outlet side of which is in turn connected to the aforementioned other end 16*b* of the bypass circuit 16, that is the low pressure side of the condenser. A circuit breaker switch 19 and a bypass switch 20 are provided in well-known manners between the outlet side of the condenser 13 and the end 16*a* of the bypass circuit 16. The circuit breaker switch 19 is operative in accordance with the pressure of the coolant on the outlet side of the condenser 13. More particularly, when this pressure reaches a first preset pressure P1 (about 26 kg/cm$^2$), it functions to disconnect the main circuit 11 so as to stop an air conditioner or the like. The bypass switch 20 is also operative in accordance with the pressure of the coolant on the outlet side of the condenser 13. More particularly, when the pressure of the coolant reaches a second preset pressure P2 (about 22 kg/cm$^2$) lower than the first preset pressure P1, it acts to open the electromagnetic valve 18, causing part of the liquid coolant having been fed out from the condenser 13 to be bypassed into the bypass circuit 16 from the end 16*a* thereof.

Figure 4:
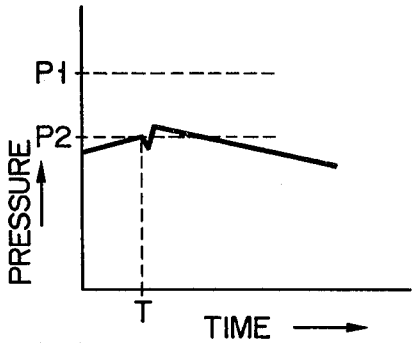
FIG. 4 is a graph showing the operational characteristic of one embodiment of the refrigeration system.

It is to be appreciated that with the refrigeration system of the above construction, in which the bypass circuit 16 includes the auxiliary capillary tube 17 disposed on the side of the inlet end 16*a* and the electromagnetic valve 18 disposed on the side of the outlet end 18, where a normal operation is performed at a refrigerating cycle, an electromagnetic valve 18 is in the closed state. At this time, a high pressure is involved on the side of the auxiliary capillary tube 17 and a low pressure on the side of the compressor 12 with the electromagnetic valve as a boundary. Here, when the coolant pressure reaches a second preset pressure P2 and the electromagnetic valve 18 is opened by the bypass switch 20, the coolant at the high pressure side of the electromagnetic valve 18 flows swiftly into the low pressure side. At this time, the high pressure coolant present at the bypass path downstream of the auxiliary capillary tube 17 flows into a low pressure side without no appreciable resistance, but the high pressure coolant at the upstream side of the auxiliary capillary tube 17 flows into the downstream side at a smaller speed due to the fluid resistance of the auxiliary capillary tube 17. Even at the instant the electromagnetic valve 18 is opened, only a small amount of coolant flows into the auxiliary capillary tube 17 and bypass and, therefore, the coolant pressure rise thereafter presents a very slow change as shown in FIG. 4. With this behavior of the coolant, the pressure of the coolant, after being temporarily reduced from the instant T of opening of the electromagnetic valve 18 as shown in FIG. 4, rises gradually and to a less extent (about 0.2 kg/cm$^2$) compared to the sudden rise to a great extent as in the prior art. Thus, it is possible to set the pressure difference between the first and second preset pressures P1 and P2 to a small value while eliminating the possibility of disconnection of the main circuit 11 and unnecessary stoppage of the air conditioner or the like immediately after coolant is admitted into the bypass circuit 16.

The above embodiment is given for the sake of illustration only, and various changes and modifications are possible. For example, it is possible to provide the circuit breaker switch 19 and bypass switch 20 on the inlet end side of the condenser 13.

As has been described in the foregoing, the invention features that in a refrigeration system, in which a main circuit is constituted by a compressor, a condenser, an expansion mechanism and an evaporator, these parts being connected in the mentioned order, and also which includes a circuit breaker switch operative in accordance with the pressure of the coolant flowing through the main circuit and serving to disconnect the main circuit upon reaching of a first preset pressure by the pressure of the coolant and a bypass switch for opening an on-off valve provided in a bypass circuit for bypassing part of the coolant from the condenser through an auxiliary expansion mechanism to the low pressure side of the compressor in response to the reaching of a second preset pressure lower than the first preset pressure by the pressure of the coolant through the main circuit, the aforementioned on-off valve is provided on the side of the auxiliary expansion mechanism in the bypass circuit nearer the compressor. Thus, the coolant flowing through the bypass circuit passes through the on-off valve after its flow speed is reduced through the auxiliary expansion mechanism, so that it is possible to set the pressure difference between the first and second preset pressures to a comparatively small value without the possibility of the disconnection of the main circuit due to a sudden rise of the coolant immediatly after the admission thereof into the bypass circuit. Thus a greater design choice may be made with respect to the refrigerating cycle, permitting the normal operation to be effected in a greater range.

What is claimed is:

1. A refrigeration system comprising:

a main circuit including a compressor, a condenser connected to the high pressure side of the compressor a main expansion mechanism connected to the outlet side of the condenser, and an evaporator connected to the outlet side of the main expansion mechanism, the outlet side of said evaporator being connected to the low pressure side of the compressor whereby a coolant is circulated through the main circuit to effect a refrigerating cycle;

a bypass circuit including an auxiliary expansion mechanism the inlet side of which is connected to the high pressure side of the compressor, and an on-off valve the inlet side of which is connected to the outlet side of the auxiliary expansion mechanism and the outlet side of which is connected to the low pressure side of the compressor;

a circuit breaker switch operative in accordance with the pressure of the coolant flowing through said main circuit and acting to disconnect the main circuit when the pressure of the coolant reaches a first preset pressure; and a bypass switch operative in accordance with the pressure of the coolant and acting to open the on-off valve so as to cause part of the coolant from the outlet side of the condenser to flow through the auxiliary expansion mechanism and on-off valve to the low pressure side of the compressor when the pressure of the coolant reaches a second preset pressure lower than the first preset pressure.

2. The refrigeration system according to claim 1, wherein said on-off valve includes an electromagnetic valve.

3. The refrigeration system according to claim 1 or 2, wherein said auxiliary expansion mechanism includes an auxiliary capillary tube.

4. The refrigeration system according to claim 3, wherein said main expansion mechanism includes a main capillary tube.

5. The refrigeration system according to claim 1, wherein said on-off valve and bypass switch are provided between the outlet side of the condenser and main expansion mechanism.

* * * * *